US010042297B2

(12) United States Patent
Sawada et al.

(10) Patent No.: US 10,042,297 B2
(45) Date of Patent: Aug. 7, 2018

(54) FIXING DEVICE AND IMAGE FORMING APPARATUS INCORPORATING SAME

(71) Applicants: Kazunari Sawada, Kanagawa (JP); Kenji Ishii, Kanagawa (JP); Kazuhito Kishi, Kanagawa (JP); Takayuki Seki, Kanagawa (JP); Ippei Fujimoto, Kanagawa (JP); Takashi Seto, Kanagawa (JP); Hiroshi Yoshinaga, Chiba (JP); Misaki Shimizu, Tokyo (JP)

(72) Inventors: Kazunari Sawada, Kanagawa (JP); Kenji Ishii, Kanagawa (JP); Kazuhito Kishi, Kanagawa (JP); Takayuki Seki, Kanagawa (JP); Ippei Fujimoto, Kanagawa (JP); Takashi Seto, Kanagawa (JP); Hiroshi Yoshinaga, Chiba (JP); Misaki Shimizu, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/375,817

(22) Filed: Dec. 12, 2016

(65) Prior Publication Data

US 2017/0176906 A1 Jun. 22, 2017

(30) Foreign Application Priority Data

Dec. 18, 2015 (JP) ..... 2015-247215
Nov. 8, 2016 (JP) ..... 2016-217938

(51) Int. Cl.
*G03G 15/20* (2006.01)

(52) U.S. Cl.
CPC ..... *G03G 15/2053* (2013.01); *G03G 15/2042* (2013.01)

(58) Field of Classification Search
CPC ..... G03G 15/2007; G03G 15/2014; G03G 15/2053; G03G 15/2042
See application file for complete search history.

(56) References Cited

U.S. PATENT DOCUMENTS

2009/0257794 A1* 10/2009 Kaino ..... G03G 15/2053 399/329
2012/0033987 A1* 2/2012 Ikegami ..... G03G 15/5029 399/82

(Continued)

FOREIGN PATENT DOCUMENTS

JP 2010-32631 2/2010
JP 2015-64561 4/2015

OTHER PUBLICATIONS

Machine Translation of JP 2010-032631. Feb. 12, 2010.*
U.S. Appl. No. 15/178,079, filed Jun. 9, 2016.

*Primary Examiner* — Carla Therrien
(74) *Attorney, Agent, or Firm* — Oblon, McClelland, Maier & Neustadt, L.L.P.

(57) ABSTRACT

A fixing device includes a flexible endless belt formed into a loop and having an inner circumferential surface, a heater to heat the endless belt, and a nip formation assembly disposed inside the loop formed by the endless belt. The nip formation assembly includes a pressure pad made of heat-resistant resin including a hollow filler, and a supplementary thermal conductor having a belt sliding-contact face over which the inner circumferential surface of the endless belt slides. The supplementary thermal conductor is interposed between the endless belt and the pressure pad to conduct heat from the heater in an axial direction of the endless belt. The fixing device further includes a pressure rotator to press against the nip formation assembly via the endless belt to (Continued)

form a fixing nip between the endless belt and the pressure rotator, through which a recording medium bearing a toner image is conveyed.

12 Claims, 4 Drawing Sheets

(56) References Cited

U.S. PATENT DOCUMENTS

| | | | | |
|---|---|---|---|---|
| 2012/0230742 | A1* | 9/2012 | Nakagawa | B32B 1/08 399/329 |
| 2013/0011157 | A1* | 1/2013 | Kaino | G03G 15/206 399/92 |
| 2013/0336672 | A1* | 12/2013 | Mizuta | G03G 21/1867 399/75 |
| 2014/0321873 | A1* | 10/2014 | Kadowaki | G03G 15/2017 399/69 |
| 2015/0055994 | A1 | 2/2015 | Shoji et al. | |
| 2015/0277311 | A1* | 10/2015 | Iwata | G03G 15/2042 399/329 |
| 2016/0098001 | A1* | 4/2016 | Ogawa | G03G 15/2053 399/338 |
| 2016/0161890 | A1 | 6/2016 | Shoji et al. | |
| 2016/0187823 | A1* | 6/2016 | Seto | G03G 15/2082 399/329 |
| 2016/0223961 | A1 | 8/2016 | Takagi et al. | |
| 2016/0274510 | A1* | 9/2016 | Hase | G03G 15/2042 |
| 2016/0274511 | A1 | 9/2016 | Ogino et al. | |
| 2016/0274514 | A1 | 9/2016 | Ishii et al. | |
| 2016/0334742 | A1 | 11/2016 | Kobashigawa et al. | |

* cited by examiner

FIXING DEVICE AND IMAGE FORMING APPARATUS INCORPORATING SAME

CROSS-REFERENCE TO RELATED APPLICATIONS

This patent application is based on and claims priority pursuant to 35 U.S.C. § 119(a) to Japanese Patent Application Nos. 2015-247215, filed on Dec. 18, 2015, and 2016-217938, filed on Nov. 8, 2016, in the Japan Patent Office, the entire disclosure of each of which is hereby incorporated by reference herein.

BACKGROUND

Technical Field

Embodiments of the present disclosure generally relate to a fixing device and an image forming apparatus incorporating the fixing device, and more particularly, to a fixing device for fixing a toner image onto a recording medium and an image forming apparatus for forming an image on a recording medium, incorporating the fixing device.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, the image is formed on the recording medium.

Such a fixing device typically includes a fixing rotator such as a roller, a belt, or a film, and an opposed rotator such as a roller or a belt pressed against the fixing rotator. The toner image is fixed onto the recording medium under heat and pressure while the recording medium is conveyed between the fixing rotator and the opposed rotator.

SUMMARY

In one embodiment of the present disclosure, a novel fixing device is described that includes a flexible endless belt formed into a loop and having an inner circumferential surface, a heater to heat the endless belt, and a nip formation assembly disposed inside the loop formed by the endless belt. The nip formation assembly includes a pressure pad made of heat-resistant resin including a hollow filler, and a supplementary thermal conductor having a belt sliding-contact face over which the inner circumferential surface of the endless belt slides. The supplementary thermal conductor is interposed between the endless belt and the pressure pad to conduct heat from the heater in an axial direction of the endless belt. The fixing device further includes a pressure rotator to press against the nip formation assembly via the endless belt to form a fixing nip between the endless belt and the pressure rotator, through which a recording medium bearing a toner image is conveyed.

Also described is a novel image forming apparatus that includes an image forming device to form a toner image and the fixing device described above, disposed downstream from the image forming device in a recording medium conveyance direction, to fix the toner image on a recording medium.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
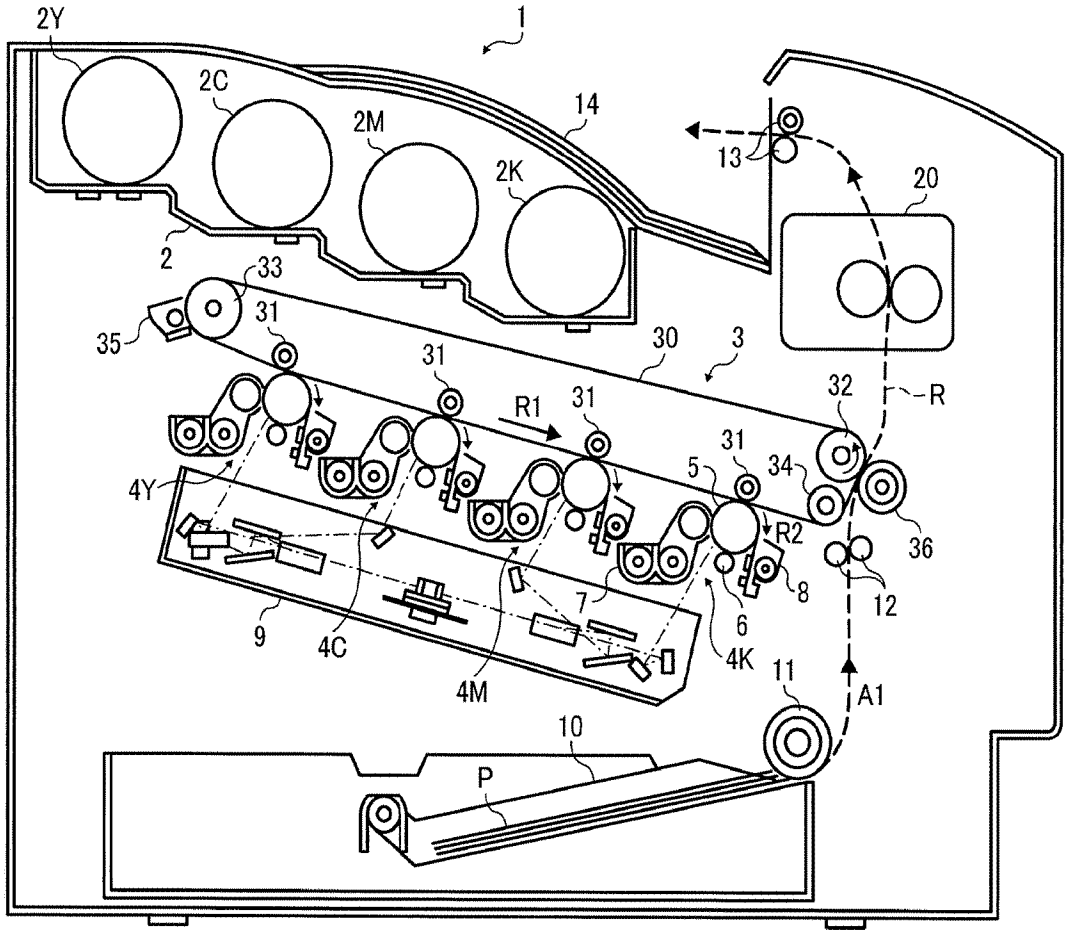
FIG. 1 is a schematic view of an image forming apparatus according to an embodiment of the present disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes Y, C, M, and K denote colors yellow, cyan, magenta, and black, respectively. To simplify the description, these suffixes are omitted unless necessary.

Referring now to the drawings, embodiments of the present disclosure are described below.

Initially with reference to FIG. 1, a description is given of an overall configuration of an image forming apparatus 1 according to an embodiment of the present disclosure.

FIG. 1 is a schematic view of the image forming apparatus 1.

The image forming apparatus 1 may be a copier, a facsimile machine, a printer, a multifunction peripheral or a multifunction printer (MFP) having at least one of copying, printing, scanning, facsimile, and plotter functions, or the like. In the present embodiment, the image forming apparatus 1 a color laser printer that forms color and monochrome images on recording media by electrophotography. Alternatively, the image forming apparatus 1 may be a monochrome printer that forms a monochrome toner image on a recording medium.

As illustrated in FIG. 1, the image forming apparatus 1 includes, e.g., four image forming devices 4Y, 4C, 4M, and 4K and an intermediate transfer belt 30. The image forming devices 4Y, 4C, 4M, and 4K are situated in the center of a housing of the image forming apparatus 1, and arranged side by side along a direction in which the intermediate transfer belt 30 is stretched. The image forming devices 4Y, 4C, 4M, and 4K have identical configurations while containing different colors of toner as developer. Specifically, the image forming devices 4Y, 4C, 4M, and 4K contain toner of yellow (Y), cyan (C), magenta (M), and black (K), respectively. The colors yellow, cyan, magenta, and black correspond to color separation components of a color image.

Each of the image forming devices 4Y, 4C, 4M, and 4K is an image station that includes, e.g., a drum-shaped photoconductor 5 as a latent image bearer, a charger 6 that charges the surface of the photoconductor 5, a developing device 7 that supplies the surface of the photoconductor 5 with toner, and a cleaner 8 that cleans the surface of the photoconductor 5, as illustrated in the image forming device 4K, for example.

Below the image forming devices 4Y, 4M, 4C, and 4K is an exposure device 9 that exposes the surface of the photoconductor 5. The exposure device 9 includes, e.g., a light source, a polygon mirror, an f-θ lens, and a reflection mirror to irradiate the surface of the photoconductor 5 with a laser beam according to image data.

A transfer device 3 is disposed above the image forming devices 4Y, 4C, 4M, and 4K. The transfer device 3 includes the intermediate transfer belt 30 as a transfer body, four primary transfer rollers 31 as primary transfer devices, a secondary transfer roller 36 as a secondary transfer device, a secondary transfer backup roller 32, a cleaning backup roller 33, a tension roller 34, and a belt cleaner 35.

The intermediate transfer belt 30 is an endless belt entrained around the secondary transfer backup roller 32, the cleaning backup roller 33, and the tension roller 34. In the present embodiment, as a driver drives and rotates the secondary transfer backup roller 32 counterclockwise, the intermediate transfer belt 30 rotates in a counter-clockwise rotational direction R1 as illustrated in FIG. 1 by friction therebetween.

The four primary transfer rollers 31 sandwich the intermediate transfer belt 30 together with the respective photoconductors 5, thereby forming four primary transfer areas herein referred to as primary transfer nips between the intermediate transfer belt 30 and the photoconductors 5. A power supply of the image forming apparatus 1 is connected to the primary transfer rollers 31. The power supply applies predetermined direct current (DC) voltage and/or alternating current (AC) voltage to each of the primary transfer rollers 31.

The secondary transfer roller 36 sandwiches the intermediate transfer belt 30 together with the secondary transfer backup roller 32, thereby forming a secondary transfer area herein referred to as a secondary transfer nip between the secondary transfer roller 36 and the intermediate transfer belt 30. Similar to the primary transfer rollers 31, the power supply of the image forming apparatus 1 is connected to the secondary transfer roller 36. The power supply applies predetermined DC voltage and/or AC voltage to the secondary transfer roller 36.

The belt cleaner 35 includes a cleaning brush and a cleaning blade that contact an outer circumferential surface of the intermediate transfer belt 30.

A bottle holder 2 is disposed in an upper portion of the housing of the image forming apparatus 1. The bottle holder 2 accommodates removable four toner bottles 2Y, 2C, 2M, and 2K that contain fresh toner of yellow, cyan, magenta, and black, respectively. Toner supply tubes are interposed between the toner bottles 2Y, 2C, 2M, and 2K and the respective developing devices 7. The fresh toner is supplied from the toner bottles 2Y, 2C, 2M, and 2K to the respective developing devices 7 through the toner supply tubes.

In a lower portion of the housing of the image forming apparatus 1 are, e.g., a sheet tray 10 and a sheet feeding roller 11. The sheet tray 10 accommodates a plurality of sheets P as recording media. The sheet feeding roller 11 picks up and feeds the plurality of sheets P one at a time from the sheet tray 10 toward the secondary transfer nip formed between the secondary transfer roller 36 and the intermediate transfer belt 30. The sheets P as recording media may be plain paper, thick paper, postcards, envelopes, thin paper, coated paper, art paper, tracing paper, overhead projector (OHP) transparencies, and the like. Optionally, the image forming apparatus 1 may include a bypass feeder that imports such recording media placed on a bypass tray into the image forming apparatus 1.

In the housing of the image forming apparatus 1 is a conveyance passage R defined by internal components of the image forming apparatus 1. Along the conveyance passage R, the sheet P is conveyed from the sheet tray 10 to a sheet ejection roller pair 13 via the secondary transfer nip. The sheet ejection roller pair 13 ejects the sheet P outside the housing of the image forming apparatus 1. Along the conveyance passage R are, e.g., a registration roller pair 12, a fixing device 20, and the sheet ejection roller pair 13. The registration roller pair 12 is disposed upstream from the secondary transfer roller 36 in a sheet conveyance direction A1 as a recording medium conveyance direction. The registration roller pair 12, as a conveyance device, conveys the sheet P to the secondary transfer nip.

The fixing device 20 is disposed downstream from the secondary transfer roller 36 in the sheet conveyance direction A1. The fixing device 20 receives the sheet P bearing a toner image and fixes the toner image on the sheet P. The sheet ejection roller pair 13 is disposed downstream from the fixing device 20 in the sheet conveyance direction A1. The sheet ejection roller pair 13 ejects the sheet P onto an output tray 14. The output tray 14 is disposed atop the housing of the image forming apparatus 1. The plurality of sheets P ejected by the sheet ejection roller pair 13 rests on the output tray 14 one by one.

To provide a fuller understanding of embodiments of the present disclosure, a description is now given of an image forming operation of the image forming apparatus 1 with continued reference to FIG. 1.

When a print job starts, a driver drives and rotates the photoconductor 5 of each of the image forming devices 4Y, 4C, 4M, and 4K in a clockwise rotational direction R2 as illustrated in FIG. 1. The charger 6 uniformly charges the surface of the photoconductor 5 to a predetermined polarity. The exposure device 9 irradiates the surface of the photoconductor 5 thus charged, with a laser beam to form an electrostatic latent image on the surface of the photoconductor 5 according to image data. It is to be noted that the image data is single-color image data obtained by separating a desired full-color image into individual color components, that is, yellow, cyan, magenta, and black components. The developing device 7 supplies toner to the electrostatic latent image thus formed on the surface of the photoconductor 5 to render the electrostatic latent image visible as a toner image.

Meanwhile, when the print job starts, the driver drives and rotates the secondary transfer backup roller 32 counterclockwise in FIG. 1 to rotate the intermediate transfer belt 30 in the rotational direction R1. The power supply applies a constant voltage or constant current control voltage having a polarity opposite a polarity of the toner to each of the primary transfer rollers 31. Accordingly, a transfer electric field is generated at each of the primary transfer nips between the primary transfer rollers 31 and the respective photoconductors 5.

When the toner image formed on the photoconductor 5 reaches the primary transfer nip in accordance with rotation of the photoconductor 5, the transfer electric field thus generated transfers the toner image from the photoconductor 5 onto the intermediate transfer belt 30. Specifically, toner images of yellow, cyan, magenta, and black are superimposed one atop another while being transferred onto the intermediate transfer belt 30. Thus, a full-color toner image is formed on the surface of the intermediate transfer belt 30. The cleaner 8 removes residual toner, failed to be transferred onto the intermediate transfer belt 30 and therefore remaining on the surface of the photoconductor 5, from the photoconductor 5. Then, a discharger discharges the surface of the photoconductor 5 to initialize the surface potential of the photoconductor 5.

In the lower portion of the image forming apparatus 1, the sheet feeding roller 11 starts rotation to feed the sheet P from the sheet tray 10 toward the registration roller pair 12 along the conveyance passage R. The registration roller pair 12 is timed to convey the sheet P to the secondary transfer nip between the secondary transfer roller 36 and the intermediate transfer belt 30 so that the sheet P meets the full-color toner image formed on the surface of the intermediate transfer belt 30 at the secondary transfer nip. The secondary transfer roller 36 is applied with a transfer voltage having a polarity opposite a polarity of the charged toner contained in the full-color toner image formed on the intermediate transfer belt 30, thereby generating a transfer electric field at the secondary transfer nip.

When the full-color toner image formed on the intermediate transfer belt 30 reaches the secondary transfer nip in accordance with rotation of the intermediate transfer belt 30, the transfer electric field thus generated transfers the toner images of yellow, cyan, magenta, and black constructing the full-color toner image from the intermediate transfer belt 30 onto the sheet P collectively. The belt cleaner 35 removes residual toner, failed to be transferred onto the sheet P and therefore remaining on the intermediate transfer belt 30, from the intermediate transfer belt 30. The removed toner is conveyed and collected into the waste toner container disposed in the housing of the image forming apparatus 1.

The sheet P bearing the full-color toner image is conveyed to the fixing device 20 that fixes the full-color toner image onto the sheet P. Then, the sheet P bearing the fixed full-color toner image is conveyed to the sheet ejection roller pair 13 that ejects the sheet P onto the output tray 14 atop the image forming apparatus 1. Thus, the plurality of sheets P rests on the output tray 14.

As described above, the image forming apparatus 1 forms a full-color image on a recording medium. Alternatively, the image forming apparatus 1 may use one of the image forming devices 4Y, 4C, 4M, and 4K to form a monochrome image, or may use two or three of the image forming devices 4Y, 4C, 4M, and 4K to form a bicolor or tricolor image, respectively.

Figure 2:
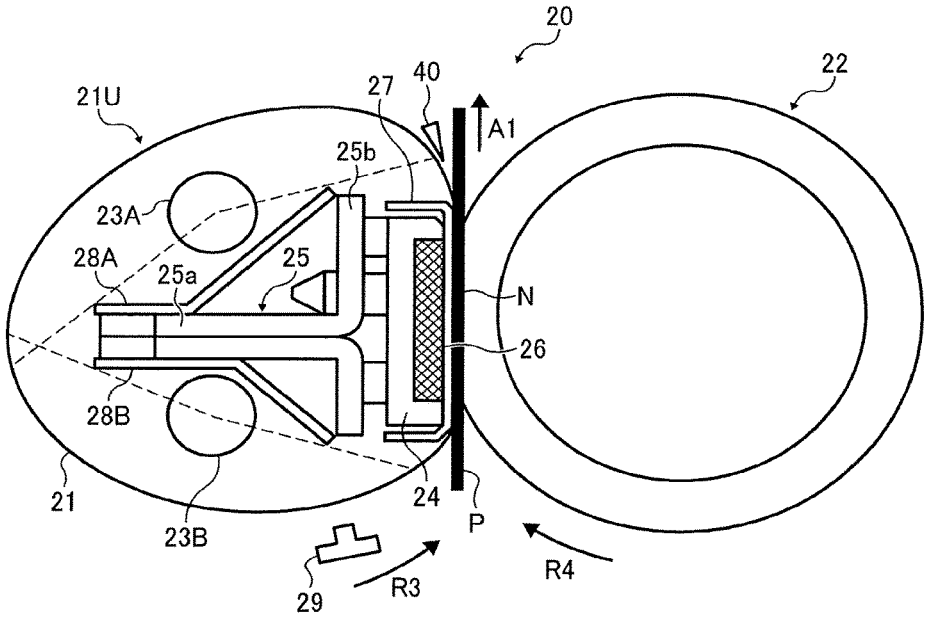
FIG. 2 is a schematic cross-sectional view of a fixing device incorporated in the image forming apparatus of FIG. 1, according to a first embodiment of the present disclosure.
Figure 3:
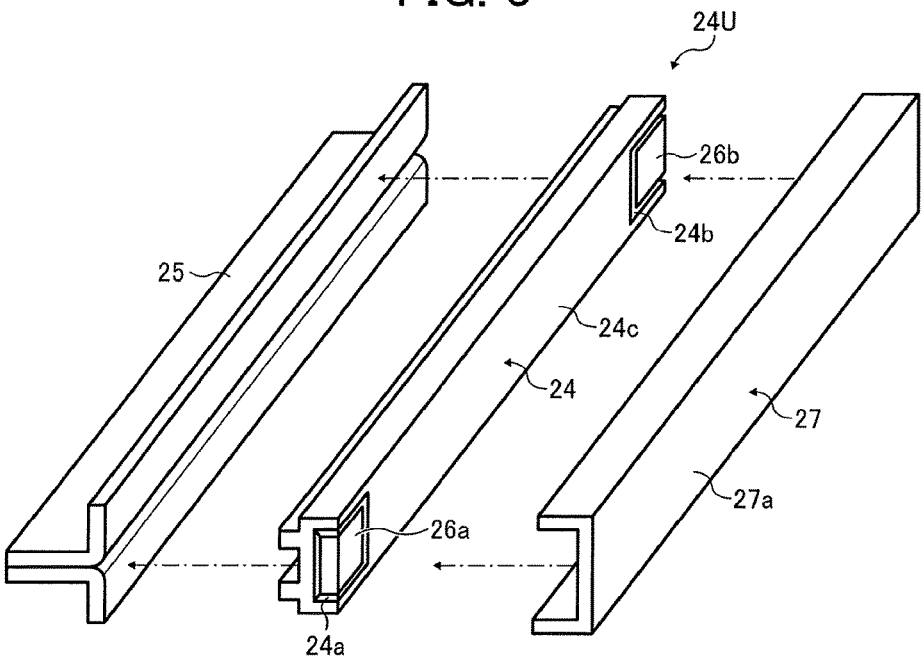
FIG. 3 is an exploded perspective view of a nip formation assembly incorporated in the fixing device of FIG. 2, illustrating relative positions of a nip formation pad, a stay, an end heater, and a supplementary thermal conductor.

Referring now to FIGS. 2 and 3, a description is given of the fixing device 20 incorporated in the image forming apparatus 1 described above.

FIG. 2 is a schematic cross-sectional view of the fixing device 20 according to a first embodiment of the present disclosure. FIG. 3 is an exploded perspective view of a nip formation assembly 24U incorporated in the fixing device 20, illustrating relative positions of a nip formation pad 24, a stay 25, an end heater 26, and a supplementary thermal conductor 27.

The fixing device 20 (e.g., a fuser or a fuser unit) includes a fixing belt 21 formed into a loop, a pressure roller 22, a temperature sensor 29, a separator 40, and various components disposed inside the loop formed by the fixing belt 21 such as a plurality of heaters 23A and 23B, the nip formation pad 24, the stay 25, the end heater 26, the supplementary thermal conductor 27, and a plurality of reflectors 28A and 28B. The fixing belt 21 and the components disposed inside the loop formed by the fixing belt 21 constitute a belt unit 21U detachably coupled to the pressure roller 22. The fixing belt 21 is an endless belt formed as a thin, flexible, tubular fixing rotator rotatable in a counter-clockwise rotational direction R3 as illustrated in FIG. 2. The pressure roller 22 is a pressure rotator that is rotatable in a clockwise rotational direction R4 as illustrated in FIG. 2 and contacts an outer circumferential surface of the fixing belt 21 at an area of contact herein referred to as a fixing nip N. The fixing belt 21 is heated by heat radiating from the heaters 23A and 23B disposed inside the loop formed by the fixing belt 21. In the present embodiment, the heaters 23A and 23B are halogen heaters. Alternatively, the heaters 23A and 23B may be induction heaters, resistance heat generators, carbon heaters, or the like.

The nip formation pad 24 extends in an axial direction, that is, a longitudinal direction, of the fixing belt 21 inside the loop formed by the fixing belt 21. The nip formation pad 24 faces the pressure roller 22 via the fixing belt 21, thereby forming the fixing nip N between the fixing belt 21 and the pressure roller 22. The stay 25 is a support that supports the nip formation pad 24 inside the loop formed by the fixing belt 21. Specifically, the stay 25 secures and supports the nip formation pad 24 against the pressure roller 22. Thus, the stay 25 prevents bending of the nip formation pad 24, thereby maintaining a uniform width of the fixing nip N throughout the length of the pressure roller 22 in an axial direction thereof. The nip formation pad 24 is made of a heat-resistant material having good mechanical strength and heatproof up to about 200° C. or higher. More specifically, the nip formation pad 24 is made of a heat-resistant resin such as polyimide (PT) resin, polyether ether ketone (PEEK)

resin, or one of those resins reinforced with glass fibers. Such a material prevents deformation of the nip formation pad 24 due to heat at a toner fixing temperature, thereby securing a stable fixing nip N, keeping output image quality stable. Opposed end portions of the stay 25 in a longitudinal direction thereof parallel to the axial direction of the fixing belt 21 are secured to and thus held by a side plate of the fixing device 20 or a holder mounted on the side plate of the fixing device 20. Similarly, opposed end portions of the heaters 23A and 23B in a longitudinal direction thereof parallel to the axial direction of the fixing belt 21 are secured to and thus held by the side plate of the fixing device 20 or the holder mounted on the side plate of the fixing device 20. The end heater 26, different from main heaters or fixing heaters (i.e., heaters 23A and 23B), includes end heaters 26*a* and 26*b* as illustrated in FIG. 3. The end heaters 26*a* and 26*b* are mounted on opposed end portions of the nip formation pad 24 in a longitudinal direction thereof parallel to the axial direction of the fixing belt 21, as integral parts of the nip formation pad 24. In the present embodiment, the end heater 26 is a contact, heat-transfer heater such as a ceramic heater.

The supplementary thermal conductor 27 (e.g., thermal equalizer) facilitates heat transfer in the axial direction of the fixing belt 21. Inside the loop formed by the fixing belt 21, the supplementary thermal conductor 27 covers a nip formation face 24*c* of the nip formation pad 24 and the surface of the end heater 26 (i.e., end heaters 26*a* and 26*b*), both of which face an inner circumferential surface of the fixing belt 21. For example, when a relatively small sheet is conveyed or when the end heater 26 is activated, the supplementary thermal conductor 27 prevents heat generated by the end heater 26 from being stored locally at an end portion of the fixing belt 21 and facilitates conduction of the heat in the axial direction of the fixing belt 21, that is, a longitudinal direction of the supplementary thermal conductor 27, thereby equalizing the temperature of the fixing belt 21 in the axial direction thereof. The supplementary thermal conductor 27 is made of a material that conducts heat well, that is, a material having enhanced thermal conductivity. The supplementary thermal conductor 27 has a flattened belt sliding-contact face 27*a* facing and directly contacting the inner circumferential surface of the fixing belt 21, thus serving as a flat nip formation face. Alternatively, the belt sliding-contact face 27*a* of the supplementary thermal conductor 27 may be given a concave shape or another shape. For example, a concave nip formation face directs a leading edge of the sheet P toward the pressure roller 22 as the sheet P is ejected from the fixing nip N, thereby facilitating separation of the sheet P from the fixing belt 21 and preventing a paper jam.

As illustrated in FIG. 2, the temperature sensor 29 is disposed at a predetermined position opposite an outer circumferential surface of the fixing belt 21 to detect the temperature of the fixing belt 21. The separator 40 is disposed downstream from the fixing nip N in the sheet conveyance direction A1 to separate the sheet P from the fixing belt 21. A pressure device is also disposed to press the pressure roller 22 against the fixing belt 21 and to separate the pressure roller 22 from the fixing belt 21.

The fixing belt 21 is an endless belt that is thin as a film and having a decreased diameter to reduce thermal capacity. The fixing belt 21 is constructed of a base layer and a release layer coating the base layer. The base layer of the fixing belt 21 is made of a metal material, such as nickel or stainless steel (e.g., steel use stainless or SUS), or a resin material such as polyimide. The release layer of the fixing belt 21 is made of, e.g., tetrafluoroethylene-perfluoroalkyl vinyl ether copolymer (PFA), or polytetrafluoroethylene (PTFE). Optionally, an elastic layer made of an elastic material such as silicon rubber, silicon rubber foam, or fluoro rubber may be interposed between the base layer and the release layer of the fixing belt 21. As the fixing belt 21 and the pressure roller 22 sandwich and press against the toner image on the sheet P passing through the fixing nip N, slight surface asperities in the fixing belt 21 may be transferred onto the toner image on the sheet P, resulting in variation in gloss of the toner image. To address this circumstance, the elastic layer may be provided with a thickness of about 100 μm. As the elastic layer deforms, the elastic layer absorbs the slight surface asperities in the fixing belt 21, thereby preventing such variation in gloss of the toner image. The fixing belt 21 has an overall thickness not larger than about 1 mm and a diameter of from about 20 mm to about 40 mm to reduce thermal capacity. The base layer of the fixing belt 21 has a thickness of from about 20 μm to about 50 μm. The elastic layer of the fixing belt 21 has a thickness of from about 100 μm to about 300 μm. The release layer of the fixing belt 21 has a thickness of from about 10 μm to about 50 μm. To further reduce thermal capacity, preferably, the fixing belt 21 may have an overall thickness not larger than about 0.2 mm, and more preferably, not larger than about 0.16 mm while having a diameter not larger than about 30 mm.

The stay 25, having a T-shaped cross section, includes a projection 25*a* and a base 25*b*. The projection 25*a* projects from the base 25*b* away from the fixing nip N in a direction perpendicular to the longitudinal direction of the stay 25. The projection 25*a* separates the heaters 23A and 23B as main heaters from each other. One of the heaters 23A and 23B has a heat generation range at a center portion in the longitudinal direction thereof to heat the fixing belt 21 and fix a toner image on a relatively small sheet P. The other one of the heaters 23A and 23B has a heat generation range at each end portion in the longitudinal direction thereof to heat the fixing belt 21 and fix a toner image on a relatively large sheet P. The heaters 23A and 23B generates heat under output control of the power supply disposed in the housing of the image forming apparatus 1, based on a surface temperature of the fixing belt 21 detected by the temperature sensor 29, thereby setting the temperature of the fixing belt 21 to a desired fixing temperature.

The reflectors 28A and 28B are interposed between the stay 25 and the heaters 23A and 23B, respectively, to reflect light radiated from the heaters 23A and 23B toward the fixing belt 21, thereby enhancing heating efficiency of the heaters 23A and 23B to heat the fixing belt 21. The reflectors 28A and 28B prevent light and heat radiated from the heaters 23A and 23B from heating the stay 25, suppressing waste of energy. Alternatively, instead of the reflectors 28A and 28B, the surface of the stay 25 facing the heaters 23A and 23B may be insulated or given a mirror finish to reflect light or heat radiating from the heaters 23A and 23B toward the fixing belt 21.

The pressure roller 22 is constructed of a tube (e.g., metal tube), an elastic layer coating the tube, and a release layer coating the elastic layer. The elastic layer is made of rubber such as silicone rubber form or fluororubber. The release layer is made of PFA or PTFE to facilitate separation of the sheet P from the pressure roller 22. As a biasing mechanism (e.g., spring) presses the pressure roller 22 against the fixing belt 21, the elastic layer of the pressure roller 22 is deformed, forming an area of contact (e.g., fixing nip N) having a predetermined width between the fixing belt 21 and the pressure roller 22. A driver such as a motor situated inside the housing of the image forming apparatus 1 drives and rotates the pressure roller 22 in the rotational direction R4. As the driver generates a driving force and rotates the pressure roller 22, the driving force is transmitted from the pressure roller 22 to the fixing belt 21 at the fixing nip N, thereby rotating the fixing belt 21 in the rotational direction R3. At the fixing nip N, the fixing belt 21 rotates while being sandwiched between the pressure roller 22 and the nip formation pad 24 having the nip formation face 24*c* covered by the supplementary thermal conductor 27. On the other hand, at a circumferential span of the fixing belt 21 other than the fixing nip N, the fixing belt 21 rotates while being guided by the side plate flange situated at each end portion of the fixing belt 21 in the axial direction thereof.

In the present embodiment, the pressure roller 22 is a solid roller. Alternatively, the pressure roller 22 may be a hollow roller, i.e., a tube. If the pressure roller 22 is a hollow roller, optionally a heater such as a halogen heater may be disposed inside the pressure roller 22. The elastic layer may be made of solid rubber. Alternatively, if no heater is situated inside the pressure roller 22, the elastic layer may be made of sponge rubber. The sponge rubber is preferable to solid rubber because the sponge rubber has enhanced insulation that draws less heat from the fixing belt 21.

As illustrated in FIG. 3, the nip formation assembly 24U includes the nip formation pad 24, the stay 25, the supplementary thermal conductor 27, and the end heater 26. The nip formation pad 24 has a surface facing away from the fixing nip N and engaging a flat surface of the stay 25 facing the fixing nip N. For example, the engaged surfaces of the nip formation pad 24 and the stay 25 may have convex and concave portions such as a pin and a boss, respectively, to be coupled to each other. The supplementary thermal conductor 27 is fitted on the nip formation pad 24 given an approximately rectangular shape, covering a surface of the nip formation pad 24 facing the inner circumferential surface of the fixing belt 21. In the present embodiment, the supplementary thermal conductor 27 engages the nip formation pad 24 with, e.g., a projection. Alternatively, the supplementary thermal conductor 27 may be attached to the nip formation pad 24 with, e.g., an adhesive. Two recesses 24*a* and 24*b* that define a difference in thickness of the nip formation pad 24 are disposed at the opposed end portions of the nip formation pad 24 in the longitudinal direction thereof. The end heaters 26*a* and 26*b* that constitute the end heater 26 illustrated in FIG. 2 are secured to the recesses 24*a* and 24*b*, respectively. Thus, the recesses 24*a* and 24*b* accommodate the end heaters 26*a* and 26*b*, respectively.

Although the belt sliding-contact face 27*a* of the supplementary thermal conductor 27 faces the inner circumferential surface of the fixing belt 21, the nip formation face 24*c* of the nip formation pad 24 facing the pressure roller 22 actually forms the fixing nip N in view of the mechanical strength that the nip formation face 24*c* of the nip formation pad 24 provides.

As described above, the supplementary thermal conductor 27 is made of a material having enhanced thermal conductivity, such as copper or aluminum, and conducts heat in the longitudinal direction thereof to prevent uneven heating of the fixing belt 21 in the axial direction thereof. However, when the heat is conducted from the fixing belt 21 to the supplementary thermal conductor 27, increased heat is conducted from the supplementary thermal conductor 27 to the nip formation pad 24. The heat conducted from the supplementary thermal conductor 27 to the nip formation pad 24 is waste energy that does not contribute to the fixing operation, serving instead merely to increase consumption of power used for the fixing operation. Hence, in the present embodiment, to reduce such waste energy that does not contribute to the fixing operation, heat conduction from the supplementary thermal conductor 27 to the nip formation pad 24 is suppressed to enhance energy efficiency of the fixing device 20 and further enhance energy efficiency of the image forming apparatus 1 overall.

Figure 4:
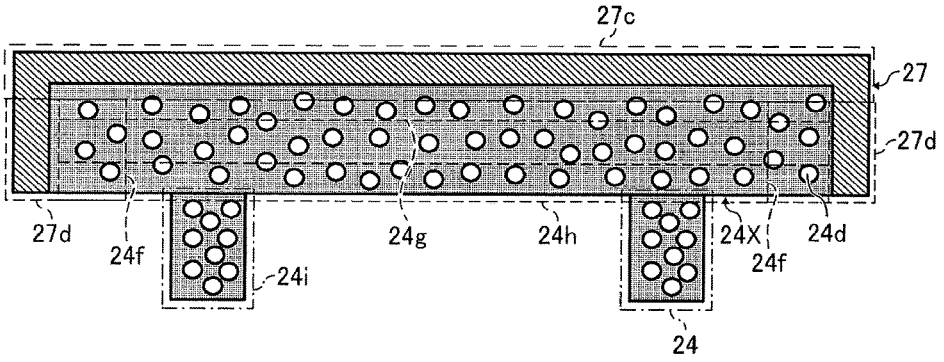
FIG. 4 is a cross-sectional view of the supplementary thermal conductor and a first example of the nip formation pad including a hollow filler.
Figure 5:
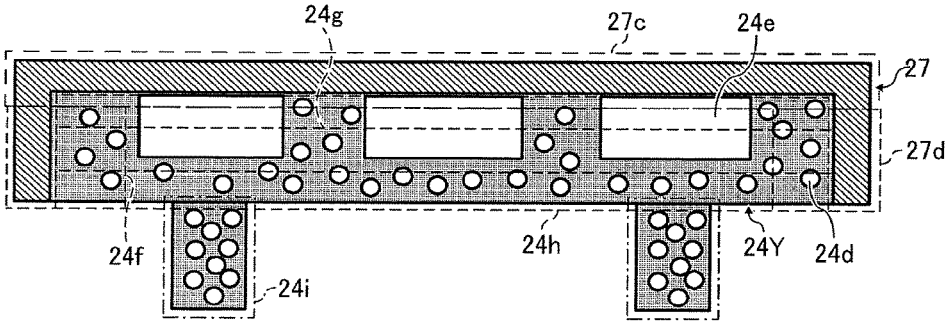
FIG. 5 is a cross-sectional view of the supplementary thermal conductor and a second example of the nip formation pad including a hollow filler.
Figure 6:
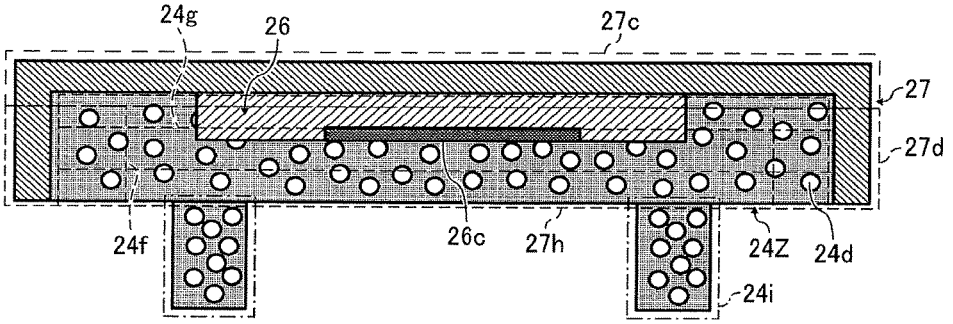
FIG. 6 is a cross-sectional end view of the supplementary thermal conductor and a third example of the nip formation pad including a hollow filler.

Referring now to FIGS. 4 through 6, a description is given of examples to suppress heat conduction from the supplementary thermal conductor 27 to the nip formation pad 24.

Initially with reference to FIG. 4, a description is given of a first example to suppress heat conduction from the supplementary thermal conductor 27 to the nip formation pad 24.

FIG. 4 is a cross-sectional view of the supplementary thermal conductor 27 and a nip formation pad 24X.

The nip formation pad 24X is made of resin including a hollow filler 24*d*. Since the hollow filler 24*d* includes air inside, the hollow filler 24*d* has a significantly lower thermal conductivity. That is, the entire thermal conductivity of the nip formation pad 24 is much lower than the thermal conductivity of a comparative nip formation pad that does not include a hollow filler. Accordingly, in the present embodiment, reduced heat is conducted to the nip formation pad 24 from the supplementary thermal conductor 27. As a result, the power consumption of the fixing device 20 is reduced. The percentage of the hollow filler 24*d* in the nip formation pad 24 depends on the required strength of the nip formation pad 24 and how much the nip formation pad 24 is heated, that is, heat resistance conditions.

The supplementary thermal conductor 27 includes a base 27*c* and projections 27*d* projecting from opposed end portions of the base 27*c* toward the stay 25. The nip formation pad 24X includes two first portions 24*f* facing the projections 27*d* of the supplementary thermal conductor 27, a second portion 24*g* defining a surface facing the supplementary thermal conductor 27, a third portion 24*h* defining a surface facing the stay 25 and substantially parallel to the base 27*c* of the supplementary thermal conductor 27, and two fourth portions 24*i* projecting toward the stay 25 from the third portion 24*h* facing the stay 25, and having an edge in contact with the stay 25. The third portion 24*h* extends from a vicinity of an edge facing the stay 25 of one of the first portions 24*f* located on one end portion of the nip formation pad 24 to a vicinity of an edge facing the stay 25 of the other of the first portions 24*f* located on the other end portion of the nip formation pad 24. Although FIG. 4 illustrates the first portion 24*f* and the third portion 24*h* of equal height, alternatively, the two portions may be of unequal height. The edge of the fourth portion 24*i* may indirectly contact the stay 25 via another component. The edge or contact portion of the fourth portion 24*i* contacting the stay 25 projects toward the stay 25 farther than an end portion of the projections 27*d* of the supplementary thermal conductor 27 in a pressurization direction in which the pressure roller 22 exerts pressure. In other words, the stay 25 does not enter a recess defined by the base 27*c* and the projection 27*d* of the supplementary thermal conductor 27.

The hollow filler 24*d* decreases not only the thermal conductivity but also the thermal capacity of the nip formation pad 24X, thereby enhancing the thermal insulation performance of the nip formation pad 24X. A brief explanation of this advantage follows.

In a fixing device in which a supplementary thermal conductor (i.e., thermal equalizer) is interposed between a fixing belt and a nip formation pad (i.e., pressure pad) made of resin and in which the fixing belt slides over the supplementary thermal conductor, thermal equalization is significantly enhanced in a longitudinal direction of the supplementary thermal conductor parallel to an axial direction of the fixing belt, compared to typical fixing devices in which the fixing belt slides over the nip formation pad made of resin or in which a frictionless sheet is interposed between the fixing belt and the supplementary thermal conductor, for example. On the other hand, since the supplementary thermal conductor absorbs increased heat in a thickness direction of the supplementary thermal conductor, a warm-up time increases while energy efficiency decreases. In short, enhanced thermal equalization in the longitudinal direction of the supplementary thermal conductor increases absorption of heat in the thickness direction of the supplementary thermal conductor. One approach to addressing this circumstance involves enhancing thermal insulation performance of the nip formation pad existing on a backside of the supplementary thermal conductor. Enhanced thermal insulation performance of the nip formation pad maintains thermal equalization performance of the supplementary thermal conductor while suppressing absorption of heat into the supplementary thermal conductor. As a result, the enhanced thermal insulation performance of the nip formation pad prevents increase in the warm-up time and enhances energy efficiency. The typical fixing devices without the supplementary thermal conductor or including the frictionless sheet having a low thermal conductivity between the supplementary thermal conductor and the fixing belt exhibits a significantly low heat absorption performance. Therefore, enhancing thermal insulation performance of the nip formation pad does not prevent increase in the warm-up time or enhance energy efficiency. In particular, the warm-up time is influenced by a heat absorption performance for a relatively short period of time. When the frictionless sheet is interposed between the fixing belt and the supplementary thermal conductor, the temperature of the fixing belt may reach a given temperature before the supplementary thermal conductor receives sufficient heat. Therefore, considering a combination of the nip formation pad and the supplementary thermal conductor, enhancing the thermal insulation performance of the nip formation pad is an advantage. Accordingly, in the present embodiment, the nip formation pad 24X is made of a resin material including the hollow filler 24*d* to enhance thermal insulation. The hollow filler 24*d* decreases not only the thermal conductivity but also the thermal capacity of the nip formation pad 24X, thereby enhancing the thermal insulation performance of the nip formation pad 24X.

At the same time, although a hollow filler mixed in a nip formation pad made of resin decreases the thermal capacity of the nip formation pad, such a hollow filler also decreases the rigidity of the nip formation pad. In other words, the hollow filler may decrease a pressure force of the nip formation pad as a pressure pad. Hence, in the present embodiment, the supplementary thermal conductor 27 is fitted on the nip formation pad 24. Since the supplementary thermal conductor 27 is made of metal having enhanced rigidity, a combined rigidity of the nip formation pad 24 and the supplementary thermal conductor 27 compensates for a decreased pressure force of the nip formation pad 24. That is, the supplementary thermal conductor 27 serves as a thermal equalizer and a supplementary pressurizer that compensates for insufficient stiffness of the nip formation pad 24X to withstand pressure from the pressure roller 22. Therefore, the nip formation pad 24X can include an increased amount of the hollow filler 24*d* to enhance the thermal insulation performance of the nip formation pad 24X. Thus, a combination of the supplementary thermal conductor 27 and the nip formation pad 24X including the hollow filler 24*d* optimizes the thermal equalization performance of the supplementary thermal conductor 27, and the thermal insulation performance and pressurization performance of the nip formation pad 24X.

Preferably, the hollow filler 24*d* may be a glass balloon material, e.g., glass balloons or glass beads, i.e., microscopic hollow bodies made of glass, because the glass balloon is relatively hard and exhibits a relatively high heat resistance. Control of glass thickness and particle diameter gives the glass balloon both a relatively high strength and a relatively low thermal conductivity. For example, hollow fillers of from about 35 μm to about 135 μm may be mixed into the nip formation pad 24X. The nip formation pad 24X has a heat deflection temperature of about 300° C. or higher and a flexural strength of, e.g., about 90 Mpa (23° C.) or higher.

Referring now to FIG. 5, a description is given of a second example to suppress heat conduction from the supplementary thermal conductor 27 to the nip formation pad 24.

FIG. 5 is a cross-sectional view of the supplementary thermal conductor 27 and a nip formation pad 24Y.

Like the nip formation pad 24X, the nip formation pad 24Y is made of resin with the hollow filler 24*d* mixed inside. In addition, the nip formation pad 24Y has a plurality of relatively large grooves 24*e* extending in a longitudinal direction of the nip formation pad 24Y on a surface facing the fixing nip N and contacting the supplementary thermal conductor 27. The plurality of grooves 24*e* are provided within a range in which the nip formation pad 24Y faces the supplementary thermal conductor 27 in the longitudinal direction of the nip formation pad 24Y. The plurality of grooves 24*e* is formed parallel to the longitudinal direction of the nip formation pad 24Y. Alternatively, the plurality of grooves 24*e* may be formed oblique to the longitudinal direction of the nip formation pad 24Y. Thus, the plurality of grooves 24*e* decreases a contact area between the supplementary thermal conductor 27 and the nip formation pad 24Y while providing an air layer therebetween. Accordingly, in the present example, decreased heat is conducted from the supplementary thermal conductor 27 to the nip formation pad 24Y, compared to the heat conducted to the nip formation pad 24X described above. As described above, the supplementary thermal conductor 27 is made of metal such as copper or aluminum. Therefore, the supplementary thermal conductor 27 has a rigidity higher than the rigidity of resin. Even when the supplementary thermal conductor 27 is given a load on a non-contact area, which is not in contact with the nip formation pad 24Y and not supported by the nip formation pad 24Y, the supplementary thermal conductor 27 maintains nip formation with its own strength. The number and dimension of the non-contact area of the supplementary thermal conductor 27 may be specified based on flexible allowance of the nip formation pad 24Y when a load is exerted on a non-contact area of the nip formation pad 24Y, which is not in contact with the supplementary thermal conductor 27. The nip formation pads 24X and 24Y have identical basic configurations, except that the nip formation pad 24Y has the plurality of grooves 24*e*.

Referring now to FIG. 6, a description is given of a third example to suppress heat conduction from the supplementary thermal conductor 27 to the nip formation pad 24.

FIG. 6 is a cross-sectional end view of the supplementary thermal conductor 27 and a nip formation pad 24Z, illustrating an end portion of the nip formation pad 24Z supporting the end heater 26.

The end heater 26 is engaged with each end portion of the nip formation pad 24Z in a longitudinal direction thereof, thus a back surface of the end heater 26 is supported by the nip formation pad 24Z. On the other hand, a front surface of the end heater 26 contacts the back side of the supplementary thermal conductor 27. As illustrated in FIG. 6, the end heater 26 includes a heat generation range 26*c* on the back surface thereof. Heat generated in the heat generation range 26*c* is conducted to the front surface of the end heater 26, and further to the supplementary thermal conductor 27. On the other hand, the heat generated in the heat generation range 26*c* is also conducted to the nip formation pad 24Z that supports the end heater 26. Since the nip formation pad 24Z is made of resin including the hollow filler 24*d* and has a decreased thermal conductivity compared to a typical nip formation pad, the end heater 26 exhibits enhanced efficiency in heating the fixing belt 21. The nip formation pads 24X and 24Z have identical basic configurations except for the end portion where the end heater 26 exists. Other than the end portion where the end heater 26 exists, the nip formation pad 24Z may be configured as illustrated in FIG. 4 partially in the longitudinal direction thereof and may be partially provided with a groove as illustrated in FIG. 5.

In the embodiment described above, the fixing device 20 includes the supplementary thermal conductor 27 and the nip formation pad 24 provided with the end heater 26. Alternatively, the supplementary thermal conductor 27 and the nip formation pad 24 may be incorporated in a fixing device without an end heater.

Figure 7:
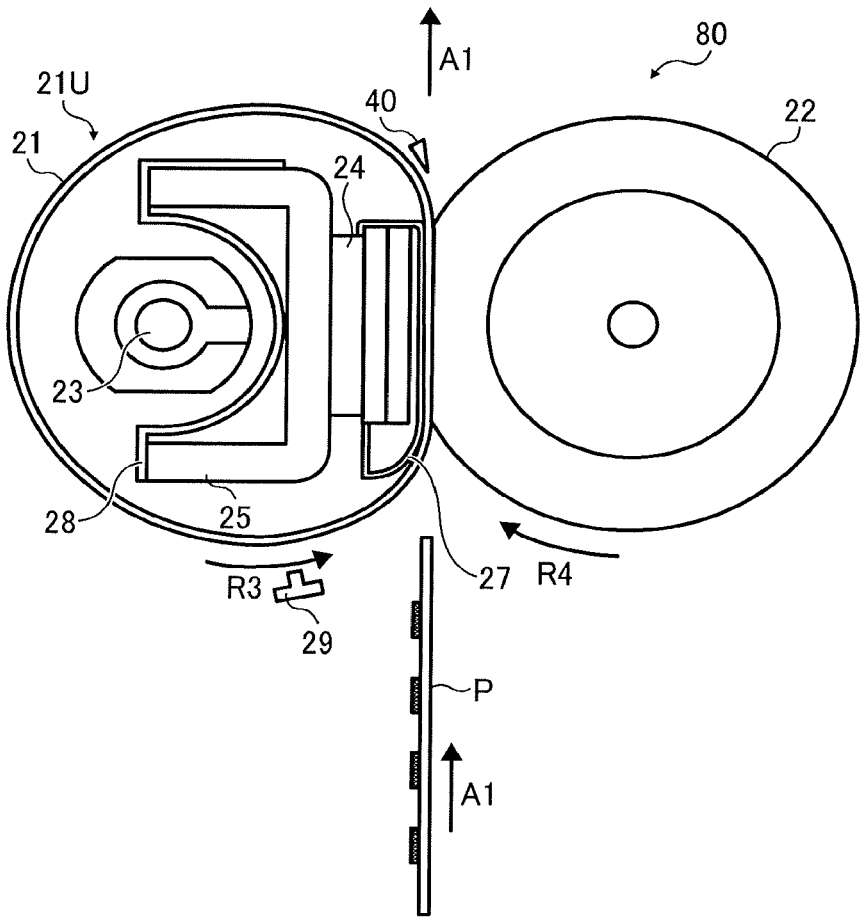
FIG. 7 is a cross-sectional view of a fixing device according to a second embodiment of the present disclosure.

FIG. 7 is a schematic cross-sectional view of a fixing device 80 according to a second embodiment of the present disclosure.

The basic configuration of the fixing device 80 is identical to the configuration of the fixing device 20 that includes the nip formation pad 24 provided with the end heater 26. However, unlike the fixing device 20, the fixing device 80 includes one main heater and no end heater. In the fixing device 80, opposed end portions of the nip formation pad 24 do not have a configuration as illustrated in FIG. 6. That is, the nip formation pad 24 may have a configuration as illustrated in FIG. 4, including the end portions. Alternatively, the nip formation pad 24 may have a configuration as illustrated in FIG. 5. In such a case, the length and shape of the grooves can be determined in a wider range compared to the grooves of the nip formation pad provided with the end heater.

Alternatively, the nip formation pad 24 may have a partial cross section illustrated in FIG. 4, partially provided with a groove as illustrated in FIG. 5.

According to the embodiments described above, a fixing device (e.g., fixing device 20) includes a nip formation pad (e.g., nip formation pad 24) and a supplementary thermal conductor (e.g., supplementary thermal conductor 27) interposed between an endless belt or fixing rotator (e.g., fixing belt 21) and the nip formation pad 24. Since the nip formation pad is made of heat-resistant resin including a hollow filler, the nip formation pad has a decreased thermal conductivity and reduces heat conducted to the nip formation pad as waste energy that does not contribute to the fixing operation. Accordingly, power consumption of the fixing device can be reduced.

The present disclosure has been described above with reference to specific embodiments. It is to be noted that the present disclosure is not limited to the details of the embodiments described above, but various modifications and enhancements are possible without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

What is claimed is:

1. A fixing device comprising:

a flexible endless belt formed into a loop and having an inner circumferential surface;

a heater to heat the endless belt;

a nip formation assembly disposed inside the loop formed by the endless belt, the nip formation assembly including:

a pressure pad made of heat-resistant resin including a hollow filler;

a stay to support the pressure pad; and a supplementary thermal conductor having a belt sliding-contact face over which the inner circumferential surface of the endless belt slides, the pressure pad including projections extending toward and contacting the stay such that the pressure pad is supported by the stay through the projections, the supplementary thermal conductor interposed between the endless belt and the pressure pad to conduct heat from the heater in an axial direction of the endless belt; and a pressure rotator to press against the nip formation assembly via the endless belt to form a fixing nip between the endless belt and the pressure rotator, through which a recording medium bearing a toner image is conveyed, wherein the heater heats the endless belt in a range which excludes the fixing nip.

2. The fixing device according to claim 1, wherein the hollow filler is a glass balloon material.

3. The fixing device according to claim 1, wherein the pressure pad has a groove extending in a longitudinal direction of the pressure pad on a surface facing the fixing nip.

4. The fixing device according to claim 3, wherein:

the groove decreases a contact area between the supplementary thermal conductor and the pressure pad.

5. The fixing device according to claim 4, wherein the groove extends in a direction perpendicular to a longitudinal direction of the pressure pad on a surface facing the fixing nip.

6. The fixing device according to claim 4, further comprising:

a second groove which decreases the contact area between the supplementary thermal conductor and the pressure pad.

7. The fixing device according to claim 1, wherein the nip formation assembly further comprises an end heater disposed at an end portion of the pressure pad in a longitudinal direction of the pressure pad.

8. The fixing device according to claim 7, wherein the end heater is a contact, heat-transfer heater.

9. An image forming apparatus comprising:

an image forming device to form a toner image; and the fixing device according to claim 1, disposed downstream from the image forming device in a recording medium conveyance direction, to fix the toner image on a recording medium.

10. The fixing device according to claim 1, wherein:

the supplementary thermal conductor comprises metal.

11. The fixing device according to claim 10, wherein: the supplementary thermal conductor comprises aluminum.

12. The fixing device according to claim 10, wherein: the supplementary thermal conductor comprises copper.

* * * * *